US009611444B2

(12) United States Patent
Winnen et al.

(10) Patent No.: US 9,611,444 B2
(45) Date of Patent: Apr. 4, 2017

(54) CANDLE COMPRISING A WICK, A FUEL AND A CANDLE DISH

(75) Inventors: Martin Winnen, Straelen (DE); Herbert Klewe, Dusseldorf (DE)

(73) Assignee: Gebr. Müller Kerzenfabrik AG, Straelen (DE)

( * ) Notice: Subject to any disclaimer, the term of this patent is extended or adjusted under 35 U.S.C. 154(b) by 1204 days.

(21) Appl. No.: 12/087,302

(22) PCT Filed: Feb. 2, 2007

(86) PCT No.: PCT/EP2007/000926
§ 371 (c)(1),
(2), (4) Date: Jun. 8, 2009

(87) PCT Pub. No.: WO2007/088068
PCT Pub. Date: Aug. 9, 2007

(65) Prior Publication Data

US 2010/0028820 A1 Feb. 4, 2010

(30) Foreign Application Priority Data

Feb. 2, 2006 (DE) ..... 10 2006 005 256
Feb. 17, 2006 (DE) ..... 10 2006 007 864

(51) Int. Cl.
*F23D 3/16* (2006.01)
*C11C 5/00* (2006.01)
*F21V 35/00* (2006.01)

(52) U.S. Cl.
CPC ..... *C11C 5/008* (2013.01); *F21V 35/00* (2013.01)

(58) Field of Classification Search
CPC ..... C11C 5/008; F21V 35/00
USPC ..... 431/292, 289, 302, 298, 325; 248/686
See application file for complete search history.

(56) References Cited

U.S. PATENT DOCUMENTS

| | | | | |
|---|---|---|---|---|
| 1,344,446 | A * | 6/1920 | Engman | 431/291 |
| 5,927,965 | A | 7/1999 | Pappas | |
| 6,062,847 | A | 5/2000 | Pappas | |
| 6,398,544 | B2 | 6/2002 | Wright et al. | |
| 7,003,905 | B1 * | 2/2006 | Derges | 40/124.11 |
| 2003/0064340 | A1 * | 4/2003 | Pappas | 431/298 |
| 2004/0009447 | A1 | 1/2004 | Decker | |

FOREIGN PATENT DOCUMENTS

| | | |
|---|---|---|
| AT | 402073 | 1/1997 |
| DE | 8109514 | 10/1981 |
| DE | 3640757 | 6/1988 |
| DE | 3738685 | 3/1990 |
| DE | 4120513 | 12/1992 |
| DE | 4243376 | 12/1993 |
| DE | 19548958 | 12/1996 |
| EP | 0401395 | 6/1989 |
| GB | 2412426 | 9/2005 |
| NL | 8500584 | 10/1986 |
| WO | WO-9736973 A1 | 10/1997 |

* cited by examiner

*Primary Examiner* — Alfred Basichas
(74) *Attorney, Agent, or Firm* — Schwegman Lundberg & Woessner, P.A.

(57) ABSTRACT

The invention relates to a candle comprising a wick, a fuel and a candle dish and also to a candle dish to be used in candles. The invention further relates to a fastening device comprising a candle comprising a candle dish and fastening material.

11 Claims, 2 Drawing Sheets

Section A . B

Detail D

Detail C
See description on page 8

Section A . B

Detail D'

Detail C
See description on page 8

CANDLE COMPRISING A WICK, A FUEL AND A CANDLE DISH

RELATED APPLICATIONS

This application is a U.S. National Stage filing under 35 U.S.C. 371 from International Application No. PCT/EP2007/000926 filed Feb. 2, 2007 and published in German as WO 2007/088068 A1, which claims priority from German Application No. 10 2006 005 256.0 filed Feb. 2, 2006, and from German Application No. 10 2006 007 864.0 filed Feb. 17, 2006, which applications and publication are incorporated herein by reference and made a part hereof.

The invention relates to candles, in particular to candles which can be arranged on or in carriers. The carriers may be combustible underlays or combustible receiving units, in particular candle stands and floral receiving units such as for example advent wreaths and bouquets, on or in which the candles are arranged.

Candles produce a risk of fire which is based on the fact that the combustible underlay or receiving unit can be ignited as a result of contact with the flame of the candle. This risk of fire is caused, above all in the burnt-down state, as a result of the fact that the wick of the almost burnt-out candle cannot dip into the liquid fuel and become extinguished therein when the fuel of the almost burnt-down candle runs out. In this case, a larger portion of the wick is now in contact with atmospheric oxygen and increases the size of the flame in a manner which can engulf the carrier material.

Known in the art are therefore candle receiving devices, for example in the form of fire-resistant candle cups (tea light holders, tea light cups, made mainly of glass or metal) which completely receive the candles and prevent the liquid fuel from running out and thus prevent the risk of fire specifically just before burning-out of the candles as the fuel runs out. However, a drawback of these devices is that the known candle cups, in receiving the candle, block the candle from view. Furthermore, the candle cups known in the art do not prevent slippage or tilting which is caused, for example, by shaking and as a result of which, on the one hand, the candle flame can come close to the fuel or, on the other hand, the wax can run out, thus promoting a fire.

In the prior art, this problem is solved by devices for fastening candles in which at least one pin is plunged into the fuel at the foot of the candle and thus ensures secure fastening of the candle to the carrier, in particular in advent wreaths and bouquets. However, a drawback is that the holding pins, which for reasons of stability are made of metal, are good heat conductors and can thus burn, when the candle is burnt down, holes which are close to the points for penetration into the base of the candle and through which the liquid fuel runs out. As a result of the running-out of the fuel, the flame can then engulf all of the rest of the wick and cause a fire either directly or by descending into the carrier.

Candle fastening devices containing a mount, a candle dish and a plug-in pin have therefore been developed ("Safe Stick Candle" from Richard Wenzel GmbH & Co. KG, Aschaffenburg). In this candle fastening device, a wick mount prevents the wick from falling over in the liquid fuel when the candle has almost completely burnt out. Furthermore, an elevated edge of the mount prevents the liquid fuel from running out at the end of the candle burning period. Both factors ensure that the candle self-extinguishes at the end of the burning period and prevent the formation of a fire, thus allowing the fastening device to be introduced along with the candle onto or into combustible carriers even without the risk of fire. However, one drawback is that this unit consisting of the plug-in pin and candle dish causes high costs in production. Furthermore, the candle dish has to be fastened together with the plug-in pin to the candle prior to use, thus necessitating an additional operation for fastening the candle dish. Finally, the use of the candle fastening device is limited to candles having a specific milled-out portion for receiving the elevated edge of the mount, thus forcing the consumer to use candles which are more expensive than others owing to the additional generation of the milled-out portion.

Figure 1:
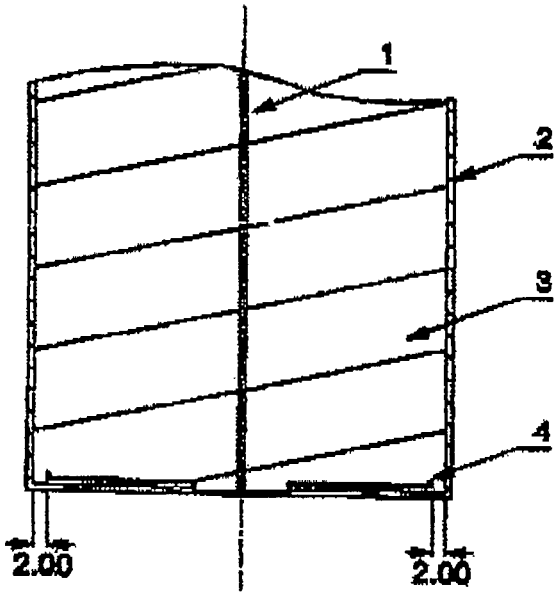
FIG. 1 shows the cross-section of a candle of the invention.

The object of the present invention is therefore to ensure self-extinguishing of the flame of candles close to the end of the burning period even on or in combustible carriers without having to fasten to the candle a candle dish which is visible when the candle is in use.

This object is achieved by a candle dish which, in a candle comprising the wick, the fuel and the candle dish, is a plate arranged in the region of the base of the candle. The plate-like candle dish causes a separation of run-out fuel and the wick and thus deprives the burning wick of the fuel. As a result of the fact that the plate is attached in the region of the base of the candle, it is substantially invisible when the candle is in use.

Preferably, the plate has a surface which is not larger than the base of the Candle. Furthermore, the shape of the plate preferably corresponds to the shape of the base of the candle. Particularly preferably, the plate and base of the candle are circular. This ensures that the plate is completely invisible when the candle is in use, not only for the most part but rather until shortly before the candle burns out, while still optimally performing its function.

The candle dish can be arranged on the fuel at the base of the candle. This allows the candle according to the invention easily to be generated from the candle plate and the fuel along with the wick, for example by compression once the candle has been generated. The candle plate can however also be attached by adhesion. Candle plates arranged in this way are visible from the base side of the candle and can therefore be marked with a reference to their function for the consumer (for example by inscribing or sticking on an appropriate label or embossing). The candle dish can however also be integrated into the fuel in the region of the base of the candle. Thus, the candle dish cannot even be seen from below the base. The candle dish can be introduced not only during or after the pressing of a candle but rather also during or after the production of a candle using a different method (for example molding, drawing or dunking). Particularly preferably, the candle dish is arranged on the candle blank prior to the application of the dip coating wax layer. The arranging on the candle blank can in this case be carried out by compression with the candle blank, in particular at the end of the pressing process for generating the candle blank or during or after the molding of the candle blank. The applying of the dip coating wax layer can serve to generate a specific visual appearance of the candle, in particular a specific color. The dip coating wax layer can however also be white or colorless.

Preferably, the candle dish is made of aluminum. The use of aluminum to produce the candle dish ensures that low material costs are required to generate the candle dishes, as aluminum can be rolled out very thin owing to its high malleability. Furthermore, the use of aluminum has the advantage that the finished candle has, owing to the lower inherent weight of aluminum, an only slightly changed weight compared to other candles not containing the candle dish. Finally, aluminum can also easily be penetrated, owing to its high ductility, by plug-in connector equipment such as, for example, fastening pins. Thus, the candles according to the invention with an aluminum candle dish can easily be arranged on the carriers with plug-in connector equipment used to penetrate the dish.

The aluminum candle dish preferably has a thickness of from 30-100 μm, particularly preferably from 48-68 μm. At lower thicknesses the aluminum becomes difficult to roll out, at higher thicknesses it can no longer be penetrated.

The candle dish may however also be made of a different fire-resistant material. Thus, for example, other metals as well as metal alloys, inorganic materials, fire-resistant plastics materials, fire-resistant composite materials, ceramic materials and also glass can be used. Preferred other metals and metal alloys include iron or steel, copper and zinc and also bronze and brass. Fire-resistant inorganic materials which can be used include, for example, silicon carbide and aluminum silicates. Fire-resistant plastics materials include, for example, thermoplastic molding compositions based on polyphenyl ethers and also conventional commercial plastics materials to which inorganic-based flame retardants, halogenated flame retardants, organophosphorus flame retardants or nitrogen-based flame retardants have been added. Hard metals, glass fiber-reinforced glass and fiber/plastics material composites can, for example, be used as fire-resistant composite materials, i.e. materials consisting of two or more materials which are joined together and divided into the subgroups of particle composite materials, fiber composite materials, layer composite materials and infiltration composite materials.

Should the candle dish be intended for applications requiring penetration with fastening material, an appropriate selection is made from the above-mentioned materials.

The candle dish preferably has a central depression. This depression can serve to receive the wick mount or the remainder of the wick itself after burning-out. Furthermore, in the case of a candle with a candle dish integrated substantially into the fuel, the depression can reveal from the outside a piece of the candle dish in the candle, thus distinguishing the candles according to the invention from conventional candles.

Furthermore, the candle dish can have elevated bordering which is configured to the side of the dish opposing the depression. This increases the stability of the dish and serves to improve the adhesion of the dish in the candle body. Furthermore, such an edge offers protection against injuries caused by cutting.

The candle dish can however also have at least one embossment to increase the stability of the dish and the adhesion of the dish in the candle. Furthermore, each embossment can additionally be provided with incisions or punchings. The incisions or punchings are, for example, angular or crescent-shaped. Preferably, they are crescent-shaped, as crescent-shaped incisions or punchings reduce the risk of injury to the operator. The incisions ensure a better bond between the candle and candle dish. Thus, the embossments, which are provided with incisions, of the candle dish cause adhesion between the candle dish and the granular material. Such embossments with incisions are also advantageous in candle molding, because the liquid candle wax can pass through them and then solidify, thus producing an intimate bond between the candle dish and the candle mass.

The embossments, which can be provided with incisions, preferably extend in the direction of the bordering in order thus to minimize the risk of the operator injuring himself on the rising metal edges.

The candle dish can also have point markings which indicate preferred positions for the penetration of plug-in connector equipment. These point markings can be either color-marked, embossed, drilled or punched. Particularly preferably, the point markings are punched, as this allows them to be introduced without the need for a further operation during the punching of the candle dish. It the point markings are embossed, the point markings can then be identical to positions having a reduced layer thickness of the candle dish material, thus simplifying the penetration of the plug-in connector equipment at these positions. The drilled or punched point markings can be configured so as to be circular or crescent-shaped. Preferably, they are punched out in the shape of a crescent, thus reducing the risk of injury. The plug-in connector equipment used is preferably metal plug-in pins or metal wire.

Figure 2:
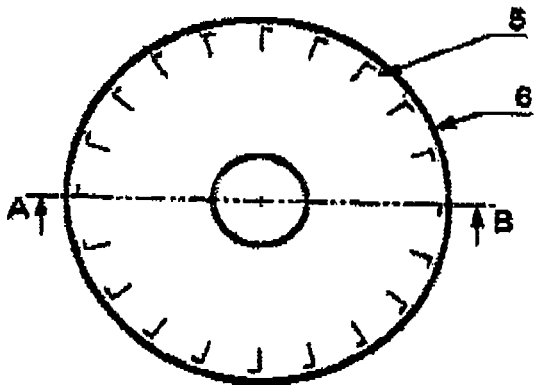
FIG. 2 shows a bottom view of a candle of the invention.
Figure 3:
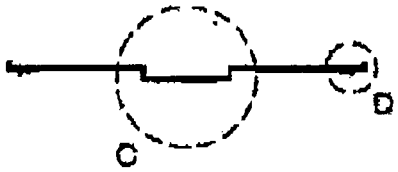
FIG. 3 shows inside features of the candle dish.
Figure 3:
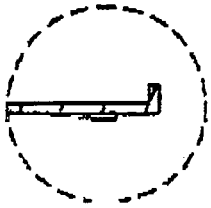
Figure 3:
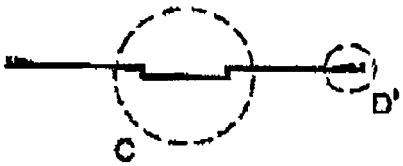
Figure 3:
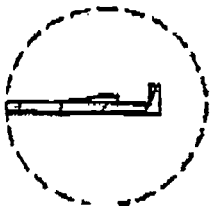

In order to illustrate the invention, FIGS. 1 to 3 follow by way of example with a list of reference numerals.

1 Wick
2 Dip coating wax layer
3 Pressed candle blank
4 Fire protection system (FPS)
pressed-in aluminum disk, aluminum for use from the packaging industry
5 Cuts
Ø FPS=Ø candle blank—4 mm Detail C In the region of the wick there is an embossment as a visible understructure and marking which enters into view as a result of the leveling of the bottom of the candle, thus revealing a safety feature which is recognizable to the manufacturing industry and/or to small-scale private manufacturers.

Details D and D'

The perpendicularly embossed edge increases the stability and promotes adhesion in the candle body; for larger diameters, continuous angular cuts are additionally provided during the embossing process to optimize the adhesion at the bottom of the candle blank. The angle or crescent marked by these cuts can be bent out of the plane of the candle dish downward (detail D) and/or upward (detail D').

The invention claimed is:

1. A candle comprising:
a wick longitudinally extending from a bottom end to a top, exposed end,
a candle fuel surrounding a portion of the wick and defining at least a base surface and an outer surface,
a candle dish having a top surface and a bottom surface, the top surface of said dish including a central depression located substantially in the center of the candle dish and the candle dish being in contact with the base surface of the candle fuel, and
a dip coating wax layer surrounding the outer surface of the candle fuel and at least the bottom surface of the candle dish, wherein the top surface of the candle dish is in direct contact with the bottom end of the wick.

2. The candle as claimed in claim 1, wherein the candle dish is made of aluminum.

3. The candle as claimed in claim 2, wherein the candle dish has elevated bordering.

4. The candle as claimed in claim 2 or 3, wherein the candle dish comprises at least one embossment, the embossment or the embossments extending in the direction of the bordering.

5. The candle as claimed in claim 4, wherein the embossment is additionally provided with incisions or punchings, the incisions or punchings being crescent-shaped.

6. The candle as claimed in claim 1 or 2, wherein the candle dish has point markings to be penetrated by plug-in connector equipment and the point markings are crescent-shaped punchings.

7. The candle as claimed in claim 2, wherein the aluminum has a thickness of from 48 to 68 μm.

8. The candle as claimed in claim 2, wherein the aluminum has a thickness of from 30 to 100 μm.

9. The candle as claimed in claim 1, wherein the candle dish comprises an adhesion-promoting layer where the candle dish is in contact with the base surface of the candle fuel.

10. The candle of claim 1, wherein the candle dish is configured to separate run-out candle fuel from the wick at an end of burning of the candle fuel.

11. The candle of claim 1, wherein the candle dish is configured to deprive the wick of candle fuel at an end of burning of the candle fuel.

* * * * *